US005470227A

United States Patent [19]

Mims et al.

[11] Patent Number: 5,470,227

[45] Date of Patent: Nov. 28, 1995

[54] PILOT IGNITER TORCH WITH CUTOFF PREHEAT VALVES

[75] Inventors: Carl W. Mims, Sanger; Roger D. Zwicker, Arlington, both of Tex.

[73] Assignee: Victor Equipment Company, Denton, Tex.

[21] Appl. No.: 260,956

[22] Filed: Jun. 16, 1994

Related U.S. Application Data

[62] Division of Ser. No. 52,491, Apr. 23, 1993, Pat. No. 5,390, 855.

[51] Int. Cl.[6] ..... F23D 14/32; F23D 14/42

[52] U.S. Cl. ..... 431/255; 431/266; 431/254; 431/345; 239/528; 266/48; 266/74

[58] Field of Search ..... 431/255, 345, 431/254, 256, 266; 239/526, 528, 527; 266/48, 74

[56] References Cited

U.S. PATENT DOCUMENTS

| | | | |
|---|---|---|---|
| 2,095,710 | 10/1937 | Offutt et al. . | |
| 2,095,747 | 10/1937 | Jacobsson . | |
| 3,022,015 | 2/1962 | Burch . | |
| 3,220,459 | 11/1965 | Wilson | 431/255 |
| 3,255,803 | 6/1966 | Hach, Jr. et al. . | |
| 3,280,881 | 10/1966 | Hach, Jr. et al. . | |
| 3,431,058 | 3/1969 | Hufferd . | |
| 4,292,021 | 9/1981 | Miyagawa | 431/255 X |
| 4,348,172 | 9/1982 | Miller | 431/255 |
| 4,810,187 | 3/1989 | Nitta | 431/255 |
| 4,818,220 | 4/1989 | Kobayashi | 431/264 |
| 5,390,855 | 2/1995 | Mims et al. | 239/414 |

*Primary Examiner*—Carl D. Price
*Attorney, Agent, or Firm*—James E. Bradley

[57] ABSTRACT

A cutting torch allows the preheat oxygen and fuel valves to remain in a preset position while the torch is off. The cutting torch has preheat oxygen and fuel cutoff valves mounted in line with the adjusting valves. The cutoff valves are both operated linearly, each having an axially moving plunger. An actuator simultaneously moves the cutoff valves between opened and closed positions. The actuator has a locking device to lock them in the opened and closed positions. A pilot flame igniter utilizes a piezoelectric crystal and a pilot fuel valve positioned side by side with parallel axes. An igniter actuator in a single stroke opens the pilot fuel valve and causes an electrical spark to ignite the pilot flame.

8 Claims, 4 Drawing Sheets

PILOT IGNITER TORCH WITH CUTOFF PREHEAT VALVES

This application is a division of application Ser. No. 08/052,491, filed Apr. 23, 1993 now U.S. Pat. No. 5,390, 855.

BACKGROUND OF THE INVENTION

1. Field of the Invention

This invention relates in general to gas torches, and in particular to a torch which has cutoff valves which allow the preheat adjusting valves to remain at a desired setting, and also to a torch utilizing a pilot flame to ignite the torch flame.

2. Description of the Prior Art

A typical cutting torch operates with gaseous fuel and oxygen. The typical torch has an adjustable fuel valve for supplying fuel gas to a mixing device at the tip of the torch. The torch has an adjustable oxygen valve for supplying oxygen for mixing with the fuel to create a preheat flame when ignited. The torch also has a cutting oxygen valve which supplies a greater quantity of oxygen to the tip when cutting is desired. This latter valve is operated by a spring biased lever arm mounted to the body of the torch.

In use, the operator will open the fuel valve a small increment and ignite the torch typically by using an external striker which creates a spark. Then the operator will adjust the fuel valve and open the preheat oxygen valve until the desired flame quality is achieved for the preheat. The operator preheats the part with the preheat flame. When he desires to start cutting, the operator depresses the oxygen lever which starts the cutting process.

From time to time the operator will need to lay the torch aside while preparing for additional cutting. When this happens, the operator closes both the oxygen and the fuel valves. He then will repeat the procedure when he desires to start the preheating and cutting again. Lighting the torch in this manner is time consuming because it requires adjustment of the fuel and oxygen valves each time.

U.S. Pat. Nos. 3,255,803, F. Hach, Jr., et al., Jun. 14, 1966, and 3,280,881, F. Hach, Jr., et al., Oct. 25, 1966, disclose a torch which has preheat oxygen and fuel cutoff valves in addition to adjusting valves. The cutoff valves operate between open and closed positions, and allow the adjusting valves to remain at a desired setting. The cutoff valves are actuated by depressing the oxygen lever part way. Also, the torches in these patents have a piezoelectric igniter which is actuated by depressing the cutting oxygen lever. While these patents show a torch that is ignited electrically and allows the preset adjustment to remain on the fuel and gas valves, such torches of this nature have not been in common use.

Another proposed means for igniting a preheat flame is shown in U.S. Pat. No. 4,818,220, S. Kobayashi, Apr. 4, 1989. In that patent, a piezoelectric device ignites fuel gas being supplied to a pilot nozzle to create a pilot flame. The pilot flame then ignites the preheat flame of the torch.

SUMMARY OF THE INVENTION

In this invention a preheat oxygen cutoff valve and a preheat fuel cutoff valve are mounted in the body of the torch. These valves move linearly between open and closed positions and are contained in the oxygen and fuel passages. An actuator will simultaneously move the preheat oxygen cutoff valve and the preheat fuel cutoff valve between the open and closed positions. The actuator will retain the cutoff oxygen and fuel valves in either the open or the closed position independently of the adjusting valves and independently of any movement of the lever for the cutting oxygen valve.

The torch also has a pilot valve passage that extends through a pilot valve conduit to a pilot nozzle adjacent the tip of the torch. A piezoelectric crystal is mounted next to a pilot valve, both being linearly movable. An ignition actuator will in one stroke open the pilot valve, and then trigger the piezoelectric crystal. This results in a spark at an electrode at the pilot nozzle to create a pilot flame. The ignition actuator operates independently of the actuator means for the preheat valves.

DETAILED DESCRIPTION OF THE INVENTION

Figures 1A, 1B:
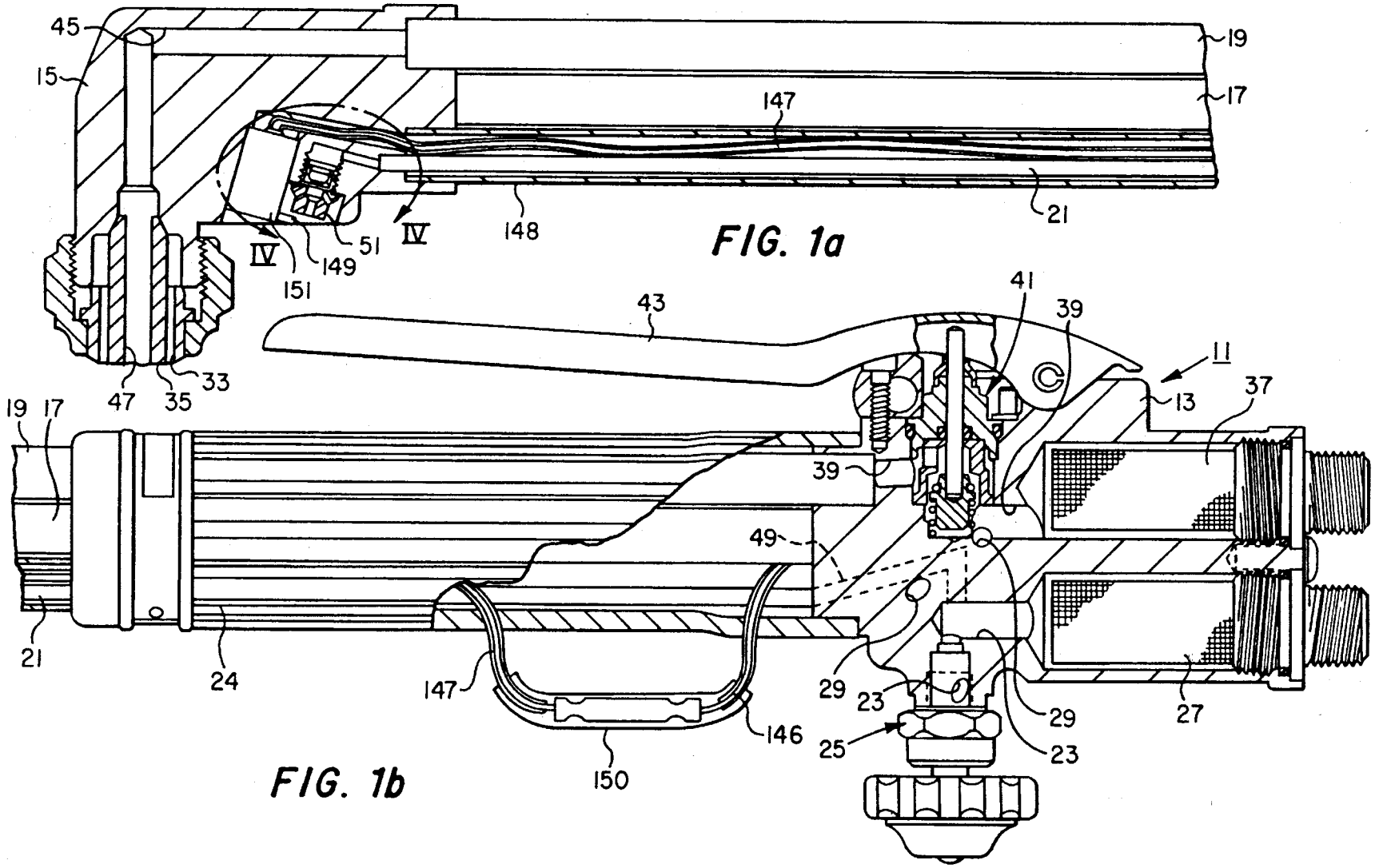
FIGS. 1*a* and 1*b* are a cross sectional view of a cutting torch constructed in accordance with this invention.

Referring to FIG. 1*b*, torch 11 has a body 13. A head 15 (FIG. 1*a*) is spaced from body 13 and connected by preheat fuel and oxygen conduits 17, 18 (see also FIG. 8), a cutting oxygen conduit 19, and a pilot fuel conduit 21. Conduits 17, 18, 19 and 21 are rigid metal tubes. A tubular grip 24 extends from body 13 and encloses a portion of the conduits 17, 18, 19 and 21.

Referring to FIG. 1*b*, body 13 has a preheat fuel passage 23 which supplies fuel from a source, the fuel being acetylene or some other type of gaseous fuel. A conventional adjusting preheat fuel valve 25 of a needle valve type will control the amount of fuel flowing through fuel passages 23. A flashback arrestor 27 locates in fuel passage 23 at the point where a fuel hose will attach. Fuel passage 23 leads to preheat fuel conduit 17, and to passages provided in the head 15.

Body 13 similarly has a preheat oxygen passage 29. Conventional needle type adjusting valve 31 (FIG. 2) will control the flow of preheat oxygen through body 13. Oxygen preheat passage 29 leads to one of the oxygen preheat conduit 18 (FIG. 8) and to passages in head 15. A mixing member (not shown) mounted in head 15 will mix the preheat fuel and the preheat oxygen, discharging the desired mixture through preheat passages 33 in tip 35, shown in FIG. 1*a*. Tip 35 is conventional and the lower portion of tip 35 is not illustrated.

A flashback arrestor 37 locates in the body 13 at the point where an oxygen hose will be attached to the body 13. Body 13 also has a cutting oxygen passage 39, from which branches the preheat oxygen passage 29. A valve 41 will control the cutting oxygen flowing through cutting oxygen passage 39. Valve 41 is actuated by a lever 43. Cutting oxygen valve 41 is biased to a closed position in a conventional manner. Cutting oxygen passage 39 leads through cutting oxygen conduit 19 to a passage 45 in head 15, as shown in FIG. 1*a*. Passage 45 leads to an axial passage 47 in tip 35.

Figure 4:
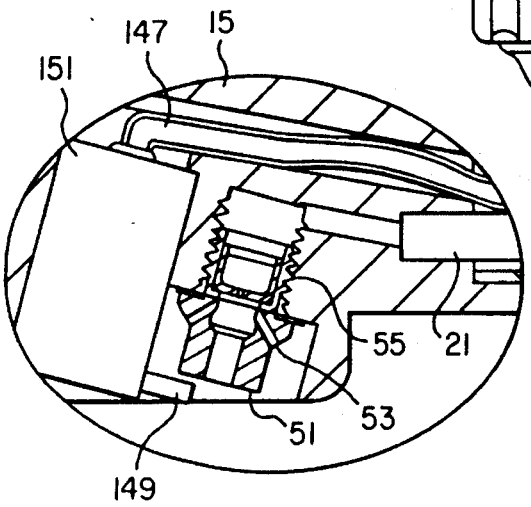
FIG. 4 is an enlarged view of a portion of the cutting torch of FIGS. 1*a* and 1*b*, illustrated by the line IV—IV of FIG. 1*a*.

As shown in FIG. 1*b*, a pilot fuel passage 49 branches from preheat fuel passage 23, as illustrated schematically by the dotted lines. Pilot fuel passage 49 leads to pilot fuel conduit 21 and to a pilot nozzle 51 mounted in head 15. As shown in FIG. 4, air mixes with fuel discharging from the pilot nozzle 51 by air mixing passages 53 located in pilot nozzle 51. Additionally, an orifice 55 located in pilot nozzle 51 for increasing the velocity of the fuel flowing therethrough to lower the pressure for mixing with the air.

Figure 5:
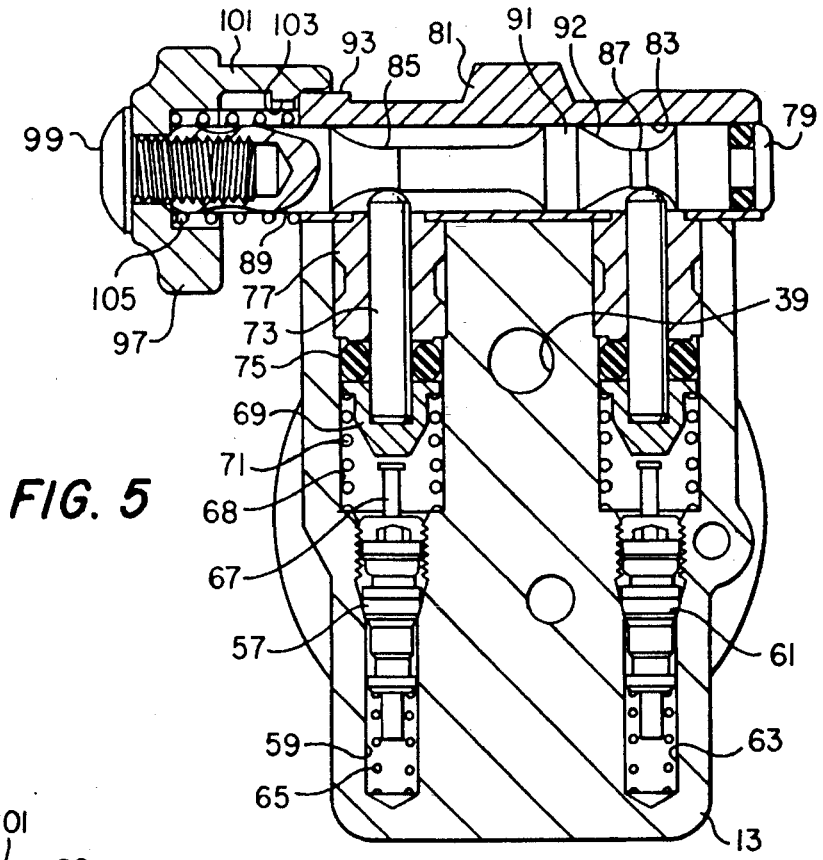
FIG. 5 is a sectional view of the cutting torch of FIGS. 1*a* and 1*b*, taken along the line V—V of FIG. 2, showing a preheat valve actuator in a closed position.

Referring to FIG. 5, a preheat fuel cutoff valve 57 located in a portion of preheat fuel passage 23 downstream of the preheat fuel valve 25 (FIG. 1*b*). Preheat fuel cutoff valve 57 is an on/off valve, preferably a Schrader type, located in a preheat fuel chamber 59. Fuel chamber 59 is in communication with and thus part of preheat fuel passage 23 (FIG. 1*b*). Similarly, a preheat oxygen cutoff valve 61 locates downstream of oxygen valve 31 (FIG. 2) in preheat oxygen passage 29 (FIG. 1*b*). Preheat oxygen cutoff valve 61 is identical to preheat fuel cutoff valve 57, also being a Schrader type. Preheat oxygen cutoff valve 61 locates in an oxygen preheat chamber 63 which is a part of preheat oxygen passage 29.

The assemblies making up the preheat fuel cutoff valve 57 and the preheat oxygen cutoff valve 61 are identical. Each cutoff valve 57, 61 has a lower spring 65 located in one of the chambers 59, 63. Lower spring 65 bears against one of the cutoff valves 57, 61. Each cutoff valve 57, 61 has a stem 67 which is reciprocable along an axis. When depressed, stem 67 will allow the flow of gas from one of the chambers 59, 63 to a plunger chamber 68 located above. Each plunger chamber 68 is in communication with one of the preheat passages 23, 29. Cutoff valves 57, 61 are secured by threads in the chambers 59, 63.

The plunger chambers 68 are of greater diameter than the chambers 59, 63. A cap 69 moves reciprocally on the axis of plunger chambers 68. An upper spring 71 pushes upward on cap 69. A plunger 73 has a lower end that locates in cap 69, and moves along the axis of plunger chamber 68. A seal 75 seals plunger 73 in plunger chamber 68. Seal 75 is stationary, and is preferably an O-ring. A bushing 77 secures within the upper end of plunger chamber 68.

Figure 6:
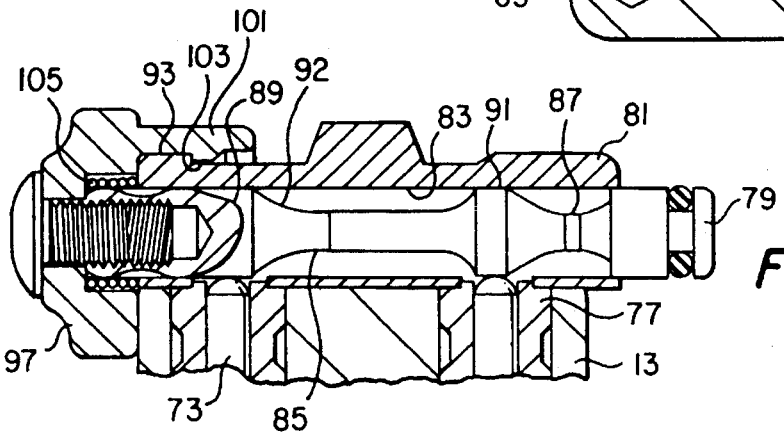
FIG. 6 is a sectional view of a portion of the cutting torch as illustrated in FIG. 5, but showing the preheat valve actuator in an open position.

Plunger 73 slides within bushing 77 and within seal 75 to selectively depress stem 67 or release it as shown in FIG. 5. FIG. 6 shows the plungers 73 in lower or open position, while FIG. 5 shows plungers 73 in the closed or upper position. Springs 71 bias the plungers 73 to the upper closed position. Plungers 73 are located side-by-side, with their axis parallel with each other.

An actuator member 79 engages the upper ends of plungers 73 to simultaneously move them between the open and closed positions. Actuator member 79 is a spool type member, with an axis that is perpendicular to the axes of plungers 73. Actuator member 79 is carried in an actuator housing 81, which has a bore 83. Actuator member 79 will not only slide axially through bore 83, but also is rotatable relative to actuator housing 81.

Actuator member 79 has two spaced apart recesses 85, 87. Recesses 85, 87 comprise smaller diameter portions of the cylindrical actuator member 79. Recesses 85, 87 engage the plungers 73, but allow them to locate in the upper closed position shown in FIG. 5. Actuator member 79 also has two cam surfaces 89, 91. Cam surfaces 89, 91 are cylindrical surfaces having a larger diameter than the recessed portions 85, 87. Cam surfaces 89, 91 are preferably of substantially the same outer diameter as the inner diameter of actuator housing bore 83. A tapered section 92 joins each recess portion 85, 87 with each cam surface 89, 91, respectively. Cam surfaces 89, 91 engage plungers 73, moving them downward as illustrated in FIG. 6. When plungers 73 move to the lower open position, stems 67 are depressed, allowing gas to flow from chambers 59, 63 into plunger chambers 68.

Figure 7:
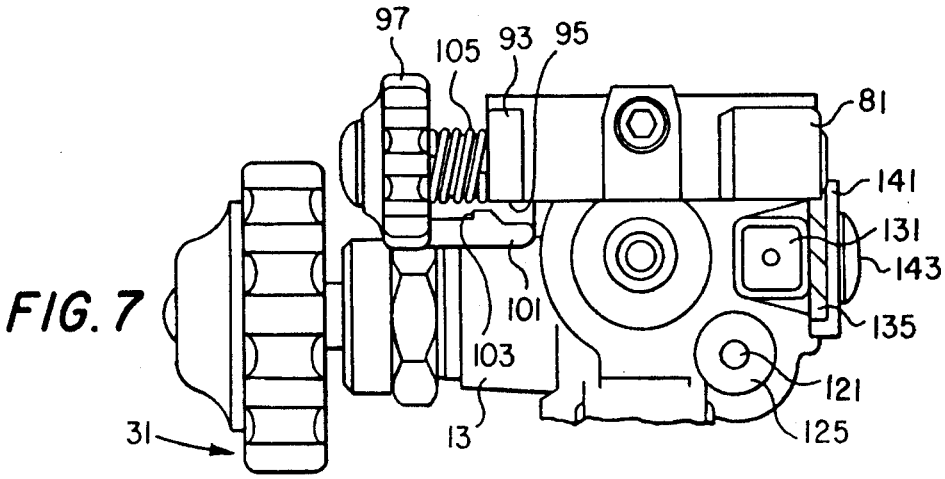
FIG. 7 is a top enlarged view of a portion of the cutting torch as illustrated in FIG. 2, but showing the locking knob rotated to a released position.

A locking means allows the operator to selectively either lock actuator member 79 in the closed position, shown in FIG. 5, or lock actuator member 79 in the open position shown in FIG. 6. The locking means includes a locking shoulder 93 formed on the exterior of actuator housing 81. The exterior of actuator housing 81 is cylindrical, but for a flat bottom and a truncated side or slot 95, shown in FIGS. 2 and 7. Locking shoulder 93 is located on what will be referred to as the outer or locking end of actuator housing 81.

A locking knob 97 is secured by a screw 99 to an outer or locking end of actuator member 79, as shown in FIG. 5. Locking knob 97, when rotated, will rotate actuator member 79 about its axis. Locking knob 97 has a tang 101. Tang 101 is a projecting member extending inward from locking knob 97. Tang 101 has an interior tab 103 which protrudes radially inward.

Tab 103 is a shoulder that engages locking shoulder 93. When tang 101 is positioned as shown in FIG. 5, tab 103 is located on the outer side of actuator housing locking shoulder 93. This interference serves as a safety means to prevent the actuator member 79 from inadvertently being moved straight inward, or to the right as illustrated in FIG. 5. When rotated clockwise 90 degrees, as shown by comparing FIGS. 2 and 7, tab 103 will now align with slot 95. Tab 103 clears slot 95, allowing actuator member 79 to be pushed straight inward, or to the right. Once tab 103 is further inward than actuator housing locking shoulder 93, rotating locking knob 97 counterclockwise 90 degrees positions tab 103 on the inner or right side of locking shoulder 93. This position is shown in FIG. 6. In this position, the interference of tab 103 with locking shoulder 93 prevents actuator member 79 from being moved to the left, or outward to the closed position. A spring 105 encircles actuator member 79 between the outer end of actuator housing 81 and the inner side of locking knob 97. Spring 105 biases actuator member 79 to the closed position shown in FIG. 5.

Figure 3:
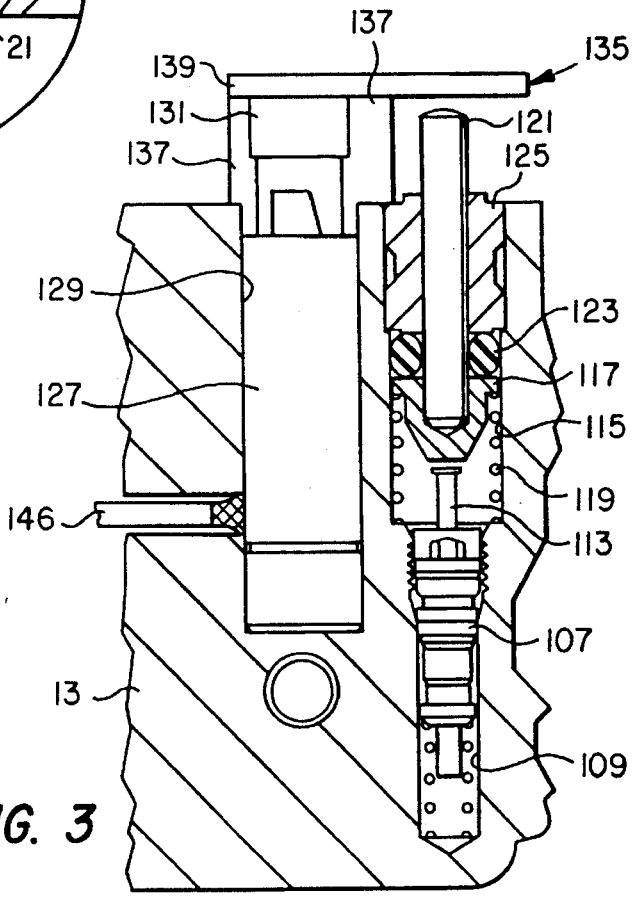
FIG. 3 is a sectional view of a portion of the cutting torch of FIG. 1, taken along the line III—III of FIG. 2.

The igniting features are illustrated in FIG. 3. A pilot valve 107 of a Schrader type is secured by threads in a pilot chamber 109. Pilot chamber 109 is located in pilot fuel passage 49 (FIG. 1*b*). A lower spring 111 locates below pilot valve 107. Pilot valve 107 has a stem 113. When depressed, stem 113 allows pilot gas to flow from chamber 109 into a plunger chamber 115. Plunger chamber 115 is also in communication with pilot fuel passages 49. A cap 117 moves axially in plunger chamber 115. Cap 117 locates on the upper end of an upper spring 119. A plunger 121 moves axially within plunger chamber 115. A seal 123 seals plunger 121 to plunger chamber 115. A bushing 125 secures in the upper end of plunger chamber 121. Depressing plunger 121 will depress stem 113 to allow fuel flow through pilot fuel passage 49 (FIG. 1*b*) to the pilot nozzle 51 (FIG. 1*a*).

A piezoelectric crystal 127 locates next to plunger 121, as shown in FIG. 3. Piezoelectric crystal 127 is located in a rectangular slot 129 (see also FIG. 8) of body 13, slot 129 having an axis that is parallel with the axis of plunger 121. Piezoelectric crystal 127 is conventional, having a trigger 131 that moves up and down on the axis to cause an electric spark to be generated by crystal 127. Trigger 131 is biased upward by an internal spring (not shown).

Figure 8:
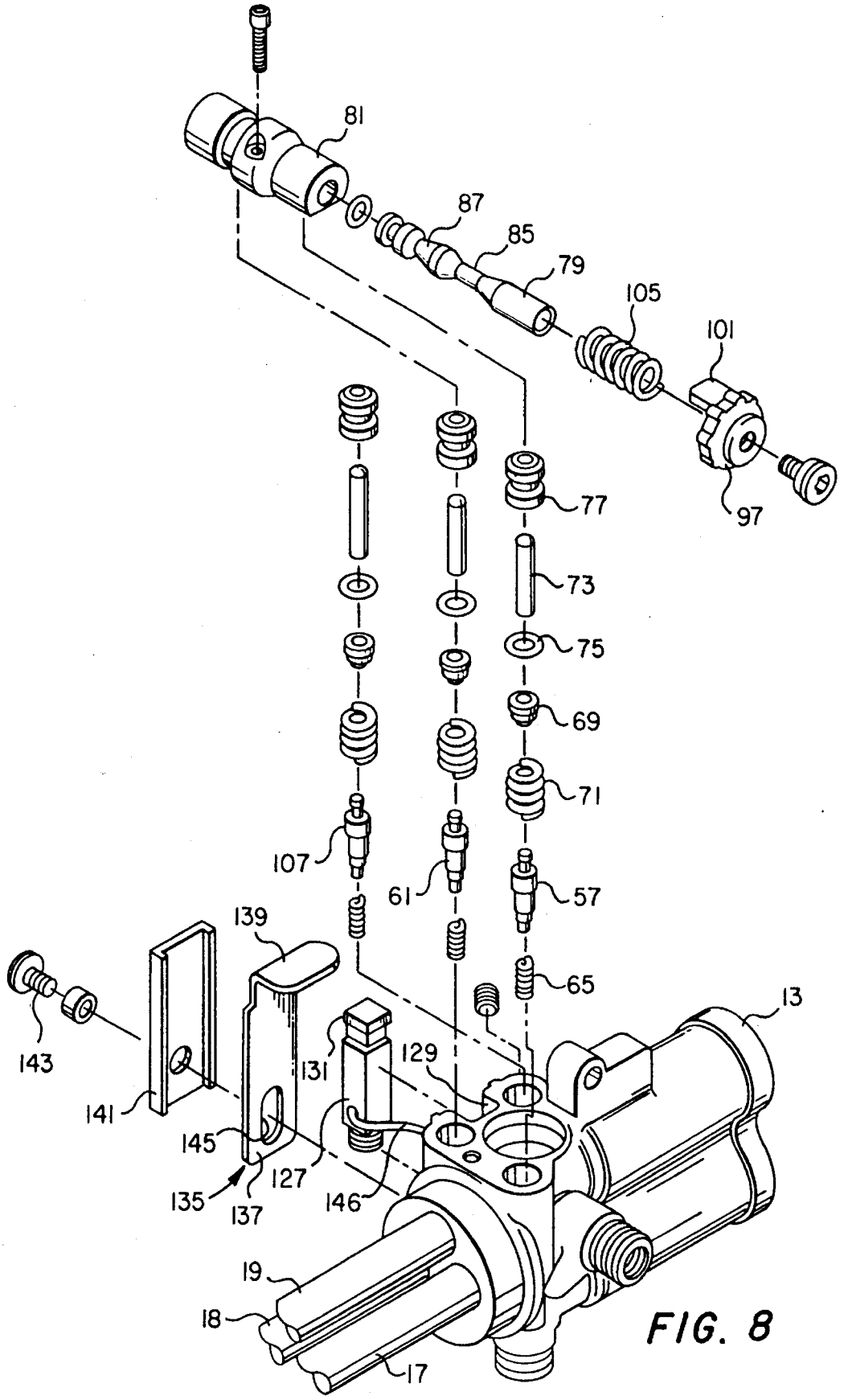
FIG. 8 is a perspective exploded view of a portion of the cutting torch of FIGS. 1*a* and 1*b*.

An ignition actuator 135 will simultaneously depress both trigger 131 and plunger 121. Ignition actuator 135 is an L-shaped plate, having a base section 137 and a flange 139. Flange 139 is at a 90 degree angle relative to base section 137 and overlies both trigger 131 and plunger 121. Flange 139 is not shown in FIGS. 2 and 7 for clarity. As shown also in FIG. 8, a retainer plate 141 retains ignition actuator 135 on body 13, but allows ignition actuator 135 to slide up and down. Retainer plate 141 secures by a screw 143 to body 13. An elongated hole 145 in base section 137 allows ignition actuator 135 to move reciprocally. As illustrated in FIG. 8, piezoelectric crystal 127 and pilot valve 107 are located adjacent the cutoff valves 57, 61, with all four axes being parallel with each other.

Referring again to FIG. 3, and also to FIG. 1*b*, piezoelectric crystal 127 secures to a wire 146. Wire 146 is spliced to a wire 147 which extends through a structural tube 148 (FIG. 1*a*) to an electrode 149 at head 15. Splice 150, which connects wire 146 to wire 147, is illustrated in FIG. 1*b*, and shown removed from grip 24 for illustration purposes only. Electrode 149 is mounted in an electrical insulator 151. Electrode 149 is positioned adjacent the discharge of pilot nozzle 51. Structural tube 148 contains not only wire 147, but also the pilot fuel conduit 21.

In operation, the operator will move actuator member 79 (FIG. 5) from the closed position shown in FIG. 5 to the open position shown in FIG. 6. The operator does this by rotating locking knob 97 clockwise, then pressing inward, compressing spring 105. Once fully inward, the operator rotates locking knob 97 counterclockwise so that tab 103 will engage the inner edge of locking shoulder 93.

Then if the adjusting valves 25 (FIG. 1*b*) and 31 (FIG. 2) have been previously closed, the operator will ignite the torch by first opening the fuel adjusting valve 25 one-fourth turn. This allows fuel flow through preheat fuel passage 23, through the preheat cutoff valve 57 (FIG. 5), through preheat conduit 17 and to the head 15. The operator then depresses igniter actuator 135 (FIG. 3) a short distance. Initially, prior to trigger 131 firing, the plunger 121 will open pilot valve 107, allowing fuel flow to pilot nozzle 51 (FIG. 1*a*). The operator may wish to momentarily hold the igniter actuator 135 in this intermediate position to assure flow of fuel through pilot fuel conduit 21 to pilot nozzle 51. Then, continued downward movement of an igniter actuator 135 causes trigger 131 to fire piezoelectric crystal 127. A spark occurs at electrode 149 (FIG. 1*a*), creating a pilot flame. The operator must maintain the igniter actuator 135 in the depressed position to sustain the pilot flame.

The pilot flame from pilot nozzle 51 will ignite the flow of fuel out the passages 33. The operator then will adjust preheat fuel valve 25 and open preheat oxygen valve 31 (FIG. 2) to achieve a desired quality for a preheat flame out tip passages 33 (FIG. 1*a*). Immediately upon the ignition of the flame at tip 35, the operator will release pressure on ignition actuator 135 (FIG. 3), allowing it to spring back upward. Pilot valve 107 closes, stopping fuel to pilot nozzle 51 (FIG. 1*a*).

Figure 2:
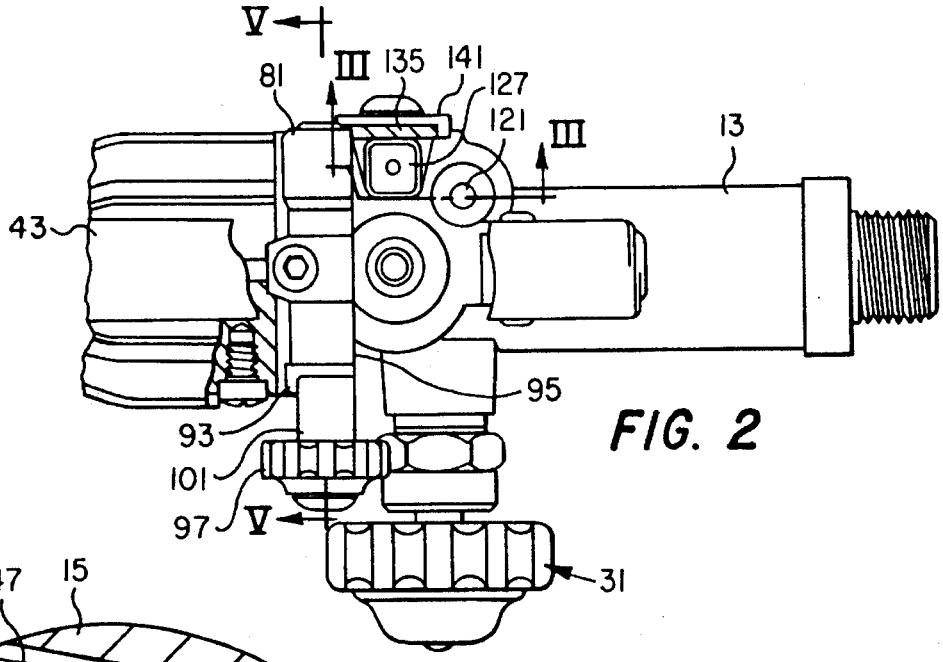
FIG. 2 is a top view of a portion of the cutting torch shown in FIG. 1*b*, and showing a locking knob in a locked position.

The operator will preheat the workpiece to be cut. At the appropriate time, the operator depresses lever 43 (FIG. 1*b*) to supply additional oxygen flow through oxygen passage 47. When the operator wishes to set aside torch 11 a relatively short time, he need not close the adjusting valves 25 (FIG. 1*b*) and 31 (FIG. 2). Rather, the precise settings which mix oxygen and fuel can remain. The operator instead moves the actuator member 79 (FIG. 5) from the open position shown in FIG. 6 to the closed position shown in FIG. 5. To do this, the operator rotates locking knob 97 clockwise to position tab 103 adjacent slot 95 clear of locking shoulder 93. Spring 105 then pushes actuator member 79 to the left to the closed position. To assure that actuator member 79 is not inadvertently pushed back to the right, the operator should then rotate locking knob 97 counterclockwise so that tab 103 will interferingly engage the outer side of locking shoulder 93. In this position, any inward directed axial force on locking knob 97 will not push actuator member 79 to the right because of the interference of tab 103 with locking shoulder 93. Once in the closed position, the flow of oxygen and fuel through the passages 23, 29 (FIG. 1*b*) ceases, extinguishing the flame at tip 33 (FIG. 1*a*).

When the operator again wishes to use torch 11, the preheat fuel valve 25 (FIG. 1*b*) and preheat oxygen valve 31 (FIG. 2) will remain in the preset desired position. The operator moves actuator member 79 (FIG. 5) to the open position, opening cutoff valves 57, 61. This causes oxygen and fuel to flow to head 15, where they mix and flow out passages 33. Shortly after, the operator will create a pilot flame at pilot nozzle 51 (FIG. 1*a*) in the same manner as previously described. The operator does this by depressing igniter actuator 135, which opens pilot fuel valve 107 and triggers piezoelectric crystal 127. This creates a spark at electrode 149 (FIG. 1*a*) to create the pilot flame. The pilot flame will ignite the mixed fuel and oxygen at tip 35. The operator then releases actuator 135 to extinguish the pilot flame at pilot nozzle 51.

The invention has significant advantages. The cutoff fuel and oxygen valves allow the adjusting fuel and oxygen valves to remain in preset positions. The actuator for the cutoff valves operates independently of the lever for the cutting oxygen. The actuator will lock the cutoff valves in either the open or the closed position. The pilot flame igniter operates easily, and is simple in structure.

While the invention has been shown in only one of its forms, it should be apparent to those skilled in the art that it is not so limited, but is susceptible to various changes without departing from the scope of the invention.

We claim:

1. In a cutting torch having a body having a preheat oxygen passage, a preheat fuel passage, and a cutting oxygen passage, the passages being connected by a plurality of conduits to a head having a tip, adjustable preheat oxygen valve means mounted to the body for delivering preheat oxygen through the preheat oxygen passage and one of the conduits to the head, adjustable preheat fuel valve means for delivery a gaseous fuel through the preheat fuel passage and one of the conduits to the head for mixing with the oxygen to create a preheat flame, and cutting oxygen valve means including a lever for supplying additional oxygen through the cutting oxygen passage and one of the conduits to the head for mixing with the preheat flame for cutting, an improved means for extinguishing the flame while retaining preset adjustment of the oxygen valve means and fuel valve means, comprising in combination:

a preheat oxygen cutoff valve means mounted in the preheat oxygen passage and a preheat fuel cutoff valve means mounted in the preheat fuel passage for linear movement between Open and closed positions to open and block flow through the preheat oxygen passage and preheat fuel passage, respectively;

actuator means for simultaneously moving the preheat oxygen cutoff valve means and the preheat fuel cutoff valve means between the open and closed positions and for retaining the preheat oxygen cutoff valve means and the preheat fuel cutoff valve means in the open and closed positions independently of any movement of the lever for the cutting oxygen valve means;

pilot valve passage means extending through the body and through one of the conduits to a pilot nozzle located adjacent the tip of the head for delivering pilot fuel;

pilot valve means in the pilot valve passage means and having a pilot plunger linearly movable between open and closed positions, opening and closing the pilot valve passage means;

an electrode mounted adjacent the pilot nozzle;

piezoelectric crystal means mounted adjacent the pilot valve means and connected to the electrode by a wire, the piezoelectric crystal having a linearly movable trigger for causing a spark at the electrode for igniting the pilot fuel to create a pilot flame for igniting oxygen and fuel flowing out the tip from the preheat oxygen and preheat fuel passages;

the trigger and the pilot plunger having parallel axes and being mounted side-by-side; and ignition actuator means including an ignition actuator mounted adjacent the trigger and the pilot plunger for movement between an off position and an ignite position in which the pilot plunger is moved to the open position and the trigger is actuated.

2. In a torch having a body having an passage and a fuel passage connected a tip, adjustable oxygen valve means mounted to the body for delivering oxygen through the oxygen passage to the tip, adjustable fuel valve means for delivering a gaseous fuel through the fuel passage to the tip for mixing with the oxygen to create a heat flame, an improved means for extinguishing the flame while retaining preset adjustment of the oxygen valve means and fuel valve means, Comprising in combination:

an oxygen cutoff valve means mounted in the oxygen passage and a fuel cutoff valve means mounted in the fuel passage for linear movement between open and closed positions to open and block flow through the oxygen passage and fuel passage, respectively, each of the cutoff valve means having a plunger with an axis, the plungers being mounted side-by-side and with their axes parallel with each other, each of the plungers being movable along its axis for opening and closing one of the cutoff valve means;

actuator means having a linear movable actuator member for simultaneously moving the plungers of the cutoff valve means between the open and closed positions, and for retaining each of the cutoff valve means in the open and closed positions;

pilot valve passage means extending through the body to a pilot nozzle located adjacent the tip for delivering pilot fuel;

pilot valve means in the pilot valve passage means and having a pilot plunger linearly movable between open and closed positions, opening and closing the pilot valve passage means;

an electrode mounted adjacent the pilot nozzle;

piezoelectric crystal means mounted adjacent the pilot valve means and connected to the electrode by a wire, the piezoelectric crystal having a linearly movable trigger for causing a spark at the electrode for igniting the pilot fuel to create a pilot flame for igniting oxygen and fuel flowing out the tip from the preheat oxygen and preheat fuel passages;

the trigger and the pilot plunger having parallel axes and being mounted side-by-side; and ignition actuator means including an ignition actuator mounted adjacent the trigger and the pilot plunger and operable independently of the preheat actuator means for movement between an off position and an ignite position in which the pilot plunger is moved to the open position and the trigger is actuated.

3. In a cutting torch having a body having a preheat oxygen passage, a preheat fuel passage, and a cutting oxygen passage, the passages being connected by a plurality of conduits to a head having a tip, adjustable preheat oxygen valve means mounted to the body for delivering preheat oxygen through the preheat oxygen passage and one of the conduits to the head, adjustable preheat fuel valve means for delivery a gaseous fuel through the preheat fuel passage and one of the conduits to the head for mixing with the oxygen to create a preheat flame, and cutting oxygen valve means including a lever for supplying additional oxygen through the cutting oxygen passage and one of the conduits to the head for mixing with the preheat flame for cutting, an improved means for extinguishing the flame while retaining preset adjustment of the oxygen valve means and fuel valve means, comprising in combination:

a preheat oxygen cutoff valve means mounted in the preheat oxygen passage and a preheat fuel cutoff valve means mounted in the preheat fuel passage for linear movement between open and closed positions to open and block flow through the preheat oxygen passage and preheat fuel passage, respectively;

actuator means for simultaneously moving the preheat oxygen cutoff valve means and the preheat fuel cutoff valve means between the open and closed positions and for retaining the preheat oxygen cutoff valve means and the preheat fuel cutoff valve means in the open and closed positions independently of any movement of the lever for the cutting oxygen valve means;

pilot valve passage means extending through the body and through one of the conduits to a pilot nozzle located adjacent the tip of the head for delivering pilot fuel;

pilot valve means in the pilot valve passage means and having a pilot plunger linearly movable between open and closed positions, opening and closing the pilot valve passage means;

an electrode mounted adjacent the pilot nozzle:

piezoelectric crystal means mounted adjacent the pilot valve means and connected to the electrode by a wire, the piezoelectric crystal having a linearly movable trigger for causing a spark at the electrode for igniting the pilot fuel to create a pilot flame for igniting oxygen and fuel flowing out the tip from the preheat oxygen and preheat fuel passages;

the trigger and the pilot plunger having parallel axes and being mounted side-by-side; and ignition actuator means including an ignition actuator mounted adjacent the trigger and the pilot plunger for movement between an off position and an ignite position in which the pilot plunger is moved to the open position and the trigger is actuated; and wherein the trigger and the pilot plunger are mounted such that the ignition actuator moves the pilot plunger to the open position prior to the trigger causing a spark at the electrode.

4. In a cutting torch having a body having a preheat oxygen passage, a preheat fuel passage, and a cutting oxygen passage, the passages being connected by a plurality of conduits to a head having a tip, adjustable preheat oxygen valve means mounted to the body for delivering preheat oxygen through the preheat oxygen passage and one of the conduits to the head, adjustable preheat fuel valve means for delivery a gaseous fuel through the preheat fuel passage and one of the conduits to the head for mixing with the oxygen to create a preheat flame, and cutting oxygen valve means including a lever for supplying additional oxygen through the cutting oxygen passage and one of the conduits to the head for mixing with the preheat flame for cutting, an improve means for extinguishing the flame while retaining preset adjustment of the oxygen valve means and fuel valve means, comprising in combination:

a preheat oxygen cutoff valve means mounted in the preheat oxygen passage and a preheat fuel cutoff valve means mounted in the preheat fuel passage for linear movement between open and closed positions to open and block flow through the preheat oxygen passage and preheat fuel passage, respectively;

actuator means for simultaneously moving the preheat oxygen cutoff valve means and the preheat fuel cutoff valve means between the open and closed positions and for retaining the preheat oxygen cutoff valve means and the preheat fuel cutoff valve means in the open and closed positions independently of any movement of the lever for the cutting oxygen valve means;

pilot valve passage means extending through the body and through one of the conduits to a pilot nozzle located adjacent the tip of the head for delivering pilot fuel;

pilot valve means in the pilot valve passage means and having a pilot plunger linearly movable between open and closed positions, opening and closing the pilot valve passage means;

an electrode mounted adjacent the pilot nozzle;

piezoelectric crystal means mounted adjacent the pilot valve means and connected to the electrode by a wire, the piezoelectric crystal having a linearly movable trigger for causing a spark at the electrode for igniting the pilot fuel to create a pilot flame for igniting oxygen and fuel flowing out the tip from the preheat oxygen and preheat fuel passages;

the trigger and the pilot plunger having parallel axes and being mounted side-by-side; and ignition actuator means including an ignition actuator mounted adjacent the trigger and the pilot plunger for movement between an off position and an ignite position in which the pilot plunger is moved to the open position and the trigger is actuated; and wherein the ignition actuator comprises:

an L-shaped member having a base which mounts slidably to the body and a flange at one end of the base which extends transverse to the base and overlies the pilot plunger and the trigger.

5. In a cutting torch having a body having a preheat oxygen passage, a preheat fuel passage, and a cutting oxygen passage, the passages being connected by a plurality of conduits to a head having a tip, adjustable preheat oxygen valve means mounted to the body for delivering preheat oxygen through the preheat oxygen passage and one of the conduits to the head, adjustable preheat fuel valve means for delivery a gaseous fuel through the preheat fuel passage and one of the conduits to the head for mixing with the oxygen to create a preheat flame, and cutting oxygen valve means including a lever for supplying additional oxygen through the cutting oxygen passage and one of the conduits to the head for mixing with the preheat flame for cutting, an improved means for extinguishing the flame while retaining preset adjustment of the oxygen valve means and fuel valve means, comprising in combination:

a preheat oxygen cutoff valve means mounted in the preheat oxygen passage and a preheat fuel cutoff valve means mounted in the preheat fuel passage for linear movement between open and closed positions to open and block flow through the preheat oxygen passage and preheat fuel passage, respectively;

actuator means for simultaneously moving the preheat oxygen cutoff valve means and the preheat fuel cutoff valve means between the open and closed positions and for retaining the preheat oxygen cutoff valve means and the preheat fuel cutoff valve means in the open and closed positions independently of any movement of the lever for the cutting oxygen valve means;

pilot valve passage means extending through the body and through one of the conduits to a pilot nozzle located adjacent the tip of the head for delivering pilot fuel;

pilot valve means in the pilot valve passage means and having a pilot plunger linearly movable between open and closed positions, opening and closing the pilot valve passage means;

an electrode mounted adjacent the pilot nozzle;

piezoelectric crystal means mounted adjacent the pilot valve means and connected to the electrode by a wire, the piezoelectric crystal having a linearly movable trigger for causing a spark at the electrode for igniting the pilot fuel to create a pilot flame for igniting oxygen and fuel flowing out the tip from the preheat oxygen and preheat fuel passages;

the trigger and the pilot plunger having parallel axes and being mounted side-by-side; and ignition actuator means including an ignition actuator mounted adjacent the trigger and the pilot plunger for movement between an off position and an ignite position in which the pilot plunger is moved to the open position and the trigger is actuated; and wherein the pilot nozzle has mixing passage means for mixing air with the pilot fuel at the pilot nozzle.

6. In a torch having a body having an oxygen passage and a fuel passage connected a tip, adjustable oxygen valve means mounted to the body for delivering oxygen through the oxygen passage to the tip, adjustable fuel valve means for delivering a gaseous fuel through the fuel passage to the tip for mixing with the oxygen to create a heat flame, an improved means for extinguishing the flame while retaining preset adjustment of the oxygen valve means and fuel valve means, comprising in combination:

an oxygen cutoff valve means mounted in the oxygen passage and a fuel cutoff valve means mounted in the fuel passage for linear movement between open and closed positions to open and block flow through the oxygen passage and fuel passage, respectively, each of the cutoff valve means having a plunger with an axis, the plungers being mounted side-by-side and with their axes parallel with each other, each of the plungers being movable along its axis for opening and closing one of the cutoff valve means;

actuator means having a linear movable actuator member for simultaneously moving the plungers of the cutoff valve means between the open and closed positions, and for retaining each of the cutoff valve means in the open and closed positions;

pilot valve passage means extending through the body to a pilot nozzle located adjacent the tip for delivering pilot fuel;

pilot valve means in the pilot valve passage means and having a pilot plunger linearly movable between open and closed positions, opening and closing the pilot valve passage means;

an electrode mounted adjacent the pilot nozzle;

piezoelectric crystal means mounted adjacent the pilot valve means and connected to the electrode by a wire, the piezoelectric crystal having a linearly movable trigger for causing a spark at the electrode for igniting the pilot fuel to create a pilot flame for igniting oxygen and fuel flowing out the tip from the preheat oxygen and preheat fuel passages;.

the trigger and the pilot plunger having parallel axes and being mounted side-by-side; and ignition actuator means including an ignition actuator mounted adjacent the trigger and the pilot plunger and operable independently of the preheat actuator means for movement between an off position and an ignite position in which the pilot plunger is moved to the open position and the trigger is actuated; and wherein the trigger and the pilot plunger are mounted such that the ignition actuator moves the pilot plunger to the open position prior to the trigger causing a spark at the electrode.

7. In a torch having a body having an oxygen passage and a fuel passage connected a tip, adjustable oxygen valve means mounted to the body for delivering oxygen through the oxygen passage to the tip, adjustable fuel valve means for delivering a gaseous fuel through the fuel passage to the tip for mixing with the oxygen to create a heat flame, an improved means for extinguishing the flame while retaining preset adjustment of the oxygen valve means and fuel valve means, comprising in combination:

an oxygen cutoff valve means mounted in the oxygen passage and a fuel cutoff valve means mounted in the fuel passage for linear movement between open and closed positions to open and block flow through the oxygen passage and fuel passage, respectively, each of the cutoff valve means having a plunger with an axis, the plungers being mounted side-by-side and with their axes parallel with each other, each of the plungers being movable along its axis for opening and closing one of the cutoff valve means;

actuator means having a linear movable actuator member for simultaneously moving the plungers of the cutoff valve means between the open and closed positions, and for retaining each of the cutoff valve means in the open and closed positions;

pilot valve passage means extending through the body to a pilot nozzle located adjacent the tip for delivering pilot fuel;

pilot valve means in the pilot valve passage means and having a pilot plunger linearly movable between open and closed positions, opening and closing the pilot valve passage means;

an electrode mounted adjacent the pilot nozzle;

piezoelectric crystal means mounted adjacent the pilot valve means and connected to the electrode by a wire, the piezoelectric crystal having a linearly movable trigger for causing a spark at the electrode for igniting the pilot fuel to create a pilot flame for igniting oxygen and fuel flowing out the tip from the preheat oxygen and preheat fuel passages;

the trigger and the pilot plunger having parallel axes and being mounted side-by-side; and ignition actuator means including an ignition actuator mounted adjacent the trigger and the pilot plunger and operable independently of the preheat actuator means for movement between an off position and an ignite position in which the pilot plunger is moved to the open position and the trigger is actuated; and wherein the ignition actuator comprises:

an L-shaped member having a base which mounts slidably to the body and a flange at one end of the base which extends transverse to the base and overlies the pilot plunger and the trigger.

8. In a torch having a body having an oxygen passage and a fuel passage connected a tip, adjustable oxygen valve means mounted to the body for delivering oxygen through the oxygen passage to the tip, adjustable fuel valve means for delivering a gaseous fuel through the fuel passage to the tip for mixing with the oxygen to create a heat flame, an improved means for extinguishing the flame while retaining preset adjustment of the oxygen valve means and fuel valve means, comprising in combination:

an oxygen cutoff valve means mounted in the oxygen passage and a fuel cutoff valve means mounted in the fuel passage for linear movement between open and closed positions to open and block flow through the oxygen passage and fuel passage, respectively, each of the cutoff valve means having a plunger with an axis, the plungers being mounted side-by-side and with their axes parallel with each other, each of the plungers being movable along its axis for opening and closing one of the cutoff valve means;

actuator means having a linear movable actuator member for simultaneously moving the plungers of the cutoff valve means between the open and closed positions, and for retaining each of the cutoff valve means in the open and closed positions;

pilot valve passage means extending through the body to a pilot nozzle located adjacent the tip for delivering pilot fuel;

pilot valve means in the pilot valve passage means and having a pilot plunger linearly movable between open and closed positions, opening and closing the pilot valve passage means;

an electrode mounted adjacent the pilot nozzle;

piezoelectric crystal means mounted adjacent the pilot valve means and connected to the electrode by a wire, the piezoelectric crystal having a linearly movable trigger for causing a spark at the electrode for igniting the pilot fuel to create a pilot flame for igniting oxygen and fuel flowing out the tip from the preheat oxygen and preheat fuel passages;

the trigger and the pilot plunger having parallel axes and being mounted side-by-side; and ignition actuator means including an ignition actuator mounted adjacent the trigger and the pilot plunger and operable independently of the preheat actuator means for movement between an off position and an ignite position in which the pilot plunger is moved to the open position and the trigger is actuated; and wherein the pilot nozzle has mixing passage means for mixing air with the pilot fuel at the pilot nozzle.

* * * * *

UNITED STATES PATENT AND TRADEMARK OFFICE

CERTIFICATE OF CORRECTION

PATENT NO. : 5,470,227

DATED : November 28, 1995

INVENTOR(S) : Carl W. Mims et al.

It is certified that error appears in the above-identified patent and that said Letters Patent is hereby corrected as shown below:

Column 7, claim 1, line 3, "between Open and", should read ---between open and---.

Column 7, claim 2, line 36, "an passage", should read ---an oxygen passage---.

Signed and Sealed this

Sixth Day of August, 1996

*Attest:*

*Attesting Officer*

BRUCE LEHMAN

*Commissioner of Patents and Trademarks*